United States Patent [19]

Atkey

[11] 3,954,157

[45] May 4, 1976

[54] ELEVATOR LIFTING FRAME

[75] Inventor: Richard E. Atkey, Memphis, Tenn.

[73] Assignee: Dover Corporation, Memphis, Tenn.

[22] Filed: Aug. 16, 1974

[21] Appl. No.: 498,200

[52] U.S. Cl. ..... 187/17; 187/1 R; 187/95

[51] Int. Cl.[2] ..... B66B 9/04; B66B 11/04

[58] Field of Search ..... 187/1 R, 3, 4, 5, 17, 187/24, 25, 95

[56] References Cited

UNITED STATES PATENTS

| | | | |
|---|---|---|---|
| 1,986,620 | 1/1935 | Borden | 187/24 |
| 2,214,588 | 9/1940 | Lagerquist | 187/17 |
| 2,781,866 | 2/1957 | Milam | 187/17 |
| 3,215,227 | 11/1965 | MacChesney | 187/24 |
| 3,252,547 | 5/1966 | Hornedo | 187/17 |
| 3,413,767 | 12/1968 | Wilson | 187/17 X |
| 3,468,401 | 9/1969 | Letz | 187/25 |
| 3,613,834 | 10/1971 | Field | 187/17 |
| 3,631,942 | 1/1972 | Brounn | 187/1 R |
| 3,650,356 | 3/1972 | Brown | 187/17 |
| 3,741,351 | 6/1973 | Suozzo | 187/95 |

*Primary Examiner*—Evon C. Blunk
*Assistant Examiner*—James L. Rowland
*Attorney, Agent, or Firm*—Brumbaugh, Graves, Donohue & Raymond

[57] ABSTRACT

An hydraulic elevator installation for vertically transporting an elevator cab up and down in a hoistway comprises a piston fixedly mounted in a vertical position in the hoistway and a lifting frame for carrying the elevator cab. The lifting frame includes a cylinder forming a vertical support member of the lifting frame and slidably mounted about the piston for vertical reciprocating movement thereon.

8 Claims, 3 Drawing Figures

ELEVATOR LIFTING FRAME

The present invention relates to a lifting frame for hydraulic elevator installments, and, more particularly, to a novel and improved lifting frame which incorporates a cylinder of an hydraulic jack as a structural component of the lifting frame.

In practice, hydraulic elevator systems have been conventionally actuated by a central piston or plunger of the hydraulic jack, which supports an elevator cab adjacent the upper end of the piston. The piston is extensibly supported within a cylinder, which is sunk into the ground to a depth sufficient to permit the elevator cab to rest at ground or floor level when the piston is fully retracted.

In this type of installation, the amount of desired elevator cab travel determines the contracted length of the piston and cylinder combination, and thus the depth to which the cylinder must be sunk into the ground. However, the drilling of a hole in the ground of sufficient depth to receive the cylinder in proper alignment with the hoistway, and installing a casing to line the hole are expensive operations. Moreover, positioning the cylinder underground creates associated problems relating to corrosion, electrolysis and inspection. For example, corrosion of the cylinder might result in a sudden loss of fluid pressure therein, thereby rendering the elevator inoperable and necessitating extensive and costly repairs.

In earlier patents, there have been suggestions to overcome the drawbacks of conventional hydraulic elevator installations. Such prior patents have proposed to employ a pair of jack cylinders arranged laterally of an elevator cab and disposed substantially entirely above the ground or floor level. In one such arrangement, it is proposed that the elevator cab be mounted in a rectangular sling, consisting of a plurality of horizontal and vertical support members, loosely associated with and supported by the pair of cylinders. Since the cylinders are arranged entirely above the ground, no drilling is required and the only digging necessary is that required to form a relatively shallow pit below the car to accommodate hydraulic liftings and structural footings. However, this design limits the potential rise of the elevator cabs and, therefore, such arrangements are primarily advantageous only in conjunction with low-rise installations.

When more than a two-floor lift installation is desired, it has been proposed to extend the pair of cylinders above the elevator cab to a height in accordance with the distance through which the elevator cab is to be lifted. However, in all such known prior proposals, wherein the elevator cab is to be associated with the cylinder rather than the piston, a plurality of cylinders are generally utilized. Such multiple cylinder arrangments suffer from the disadvantage that they require the equilibration or balancing of the forces, produced by the elevator cab, which act on the cylinders.

Moreover, since the cylinders are located laterally of the center of the elevator cab, a cantilever effect is produced due to the location of the center of gravity in the forward portion of the elevator cab where the door, door return column, door track, sill, operating panel and operator are usually located. If this cantilever effect is great enough and is not compensated, an unacceptable binding of the piston and cylinder is likely to result, especially in high-rise installations. More pertinently, since the cylinders are located laterally of the elevator sling the weight and cost of the system is increased due to the required provision of at least a pair of cylinders and a multi-member sling, including a plurality of horizontal and vertical support members.

In accordance with the invention, there is provided a novel and improved hydraulic elevator installation which normally includes a source of hydraulic fluid and a fluid pressure responsive hydraulic jack for vertically transporting an elevator cab up and down in a hoistway. The hydraulic jack of the present invention includes a piston fixedly mounted in a vertical position in the hoistway and a cylinder slidably mounted about the piston for reciprocating vertical movement thereon, wherein the cylinder forms a rigidly integrated, vertical support member of a lifting frame.

Therefore, besides acting as the extensible portion of the hydraulic jack, the cylinder also forms a vertical support member for the lifting frame which carries the elevator cab. In addition to the cylinder, the lifting frame further includes a lower horizontal support member rigidly attached to the cylinder and an upper horizontal support member rigidly attached to the cylinder and located a predetermined distance above the lower horizontal support member. The lower and upper horizontal support members may be rigidly attached to the cylinder in any suitable conventional way such as by welding.

The cylinder and the lower and upper horizontal support members are positioned in a vertical plane substantially parallel to the door of the elevator cab to form an I-shaped lifting frame. Accordingly, the lifting frame of the invention advantageously reduces the cost of the hydraulic elevator installation by minimizing the number of elements comprising the lifting frame. Such minimization also reduces operating costs and increases efficiency by providing a lighter structure.

The cylinder extends upward through the elevator cab in the door return column thereof. Thus the lifting frame is advantageously positioned adjacent the front end of the elevator cab which, as described hereinabove, approximates the center of gravity of the elevator cab. Although a cantilever effect may still be created by a passenger or cargo load in the elevator cab, it will be much less pronounced than prior hydraulic elevator installations in which the elevator slings are positioned adjacent the central or back portion of the elevator cab, remote from the center of gravity thereof. Moreover, the utilization of a single cylinder eliminates the necessity of balancing the load, as required in prior hydraulic elevator installations employing a plurality of cylinders.

Two pairs of vertically aligned lower and upper rail guides of any suitable conventional form are carried by the lower and upper horizontal support members, respectively. The rail guides are engageable with a pair of parallel guide rails which extend upwardly in a hoistway in a vertical plane defined by the cylinder and the lower and upper horizontal support members. Thus the guide rails may be positioned adjacent the front end of the elevator cab rather than adjacent the central portion thereof, as in the conventional practice. Because the guide rails are so located, the hydraulic elevator installation of the invention may also more readily benefit from the various advantages attendant with a novel and improved rail mounting system described in my copending U.S. Pat. application Ser. No. 498,199, filed on Aug. 16, 1974.

For a more complete understanding of the invention, reference may be had to the following detailed description taken in conjunction with the accompanying figures of the drawing, in which.

Figure 1:
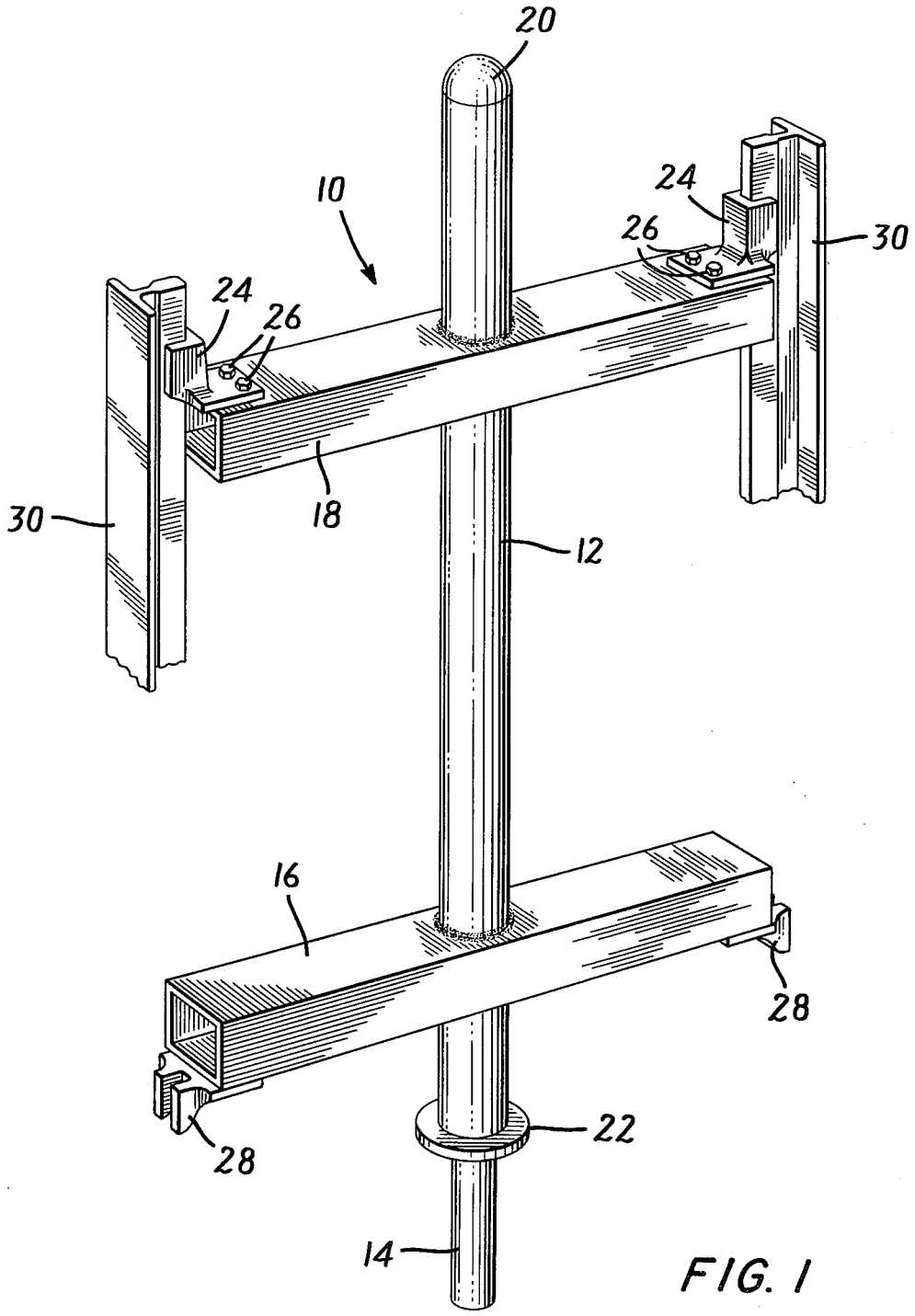
FIG. 1 is a perspective view of an exemplary embodiment of the lifting frame of the present invention.

In FIG. 1, a lifting frame 10 of the invention is mounted for vertical movement in a hoistway (not shown). The lifting frame 10 comprises a tubular cylinder 12 slidably mounted about a hollow piston 14 for vertical reciprocating movement thereon, a lower horizontal support member 16 rigidly attached by welding to the cylinder 12 and an upper horizontal support member 18 rigidly attached by welding to the cylinder 12 and located a predetermined distance above the lower horizontal support member 16.

The lower and upper horizontal support members 16, 18, respectively, are welded to the cylinder 12 intermediate the radially, outwardly extending flange 22, which circumscribes the lower end of the cylinder 12, and the bulkhead 20, which forms the upper end of the cylinder 12. Moreover, the lifting frame 10 is designed such that the cylinder 12, the lower horizontal support member 16 and the upper horizontal support member 18 all lie within the same vertical plane. In the preferred embodiment of FIGS. 1–3, the lower and upper horizontal support members 16, 18, respectively, are tubular elements having a rectangular cross-section. Although the hollow design reduces the weight of the lifting frame 10, it should be understood that any other suitable configuration or shape may be employed.

A pair of upper rail guides 24, 24 are attached to the upper horizontal support member 18 by two pairs of bolts 26, 26. Similarly, a pair of lower rail guides 28, 28 are attached, in vertical alignment with the upper rail guides 24, 24, to the lower horizontal support member 16 by two pairs of bolts (not shown). The rail guides 24, 24 and 28, 28, which are shown as U-shaped channels, may also be of the roller type. In any event, the upper rail guides 24, 24 and the lower rail guides 28, 28 are engageable with a pair of parallel T-shaped guide rails 30, 30 which extend upwardly in the hoistway (not shown) and lie in the vertical plane defined by the cylinder 12 and the lower and upper horizontal support members 16, 18, respectively. The guide rails 30, 30 center the lifting frame 10 during the vertical movement of the lifting frame 10 in the hoistway.

Figure 2:
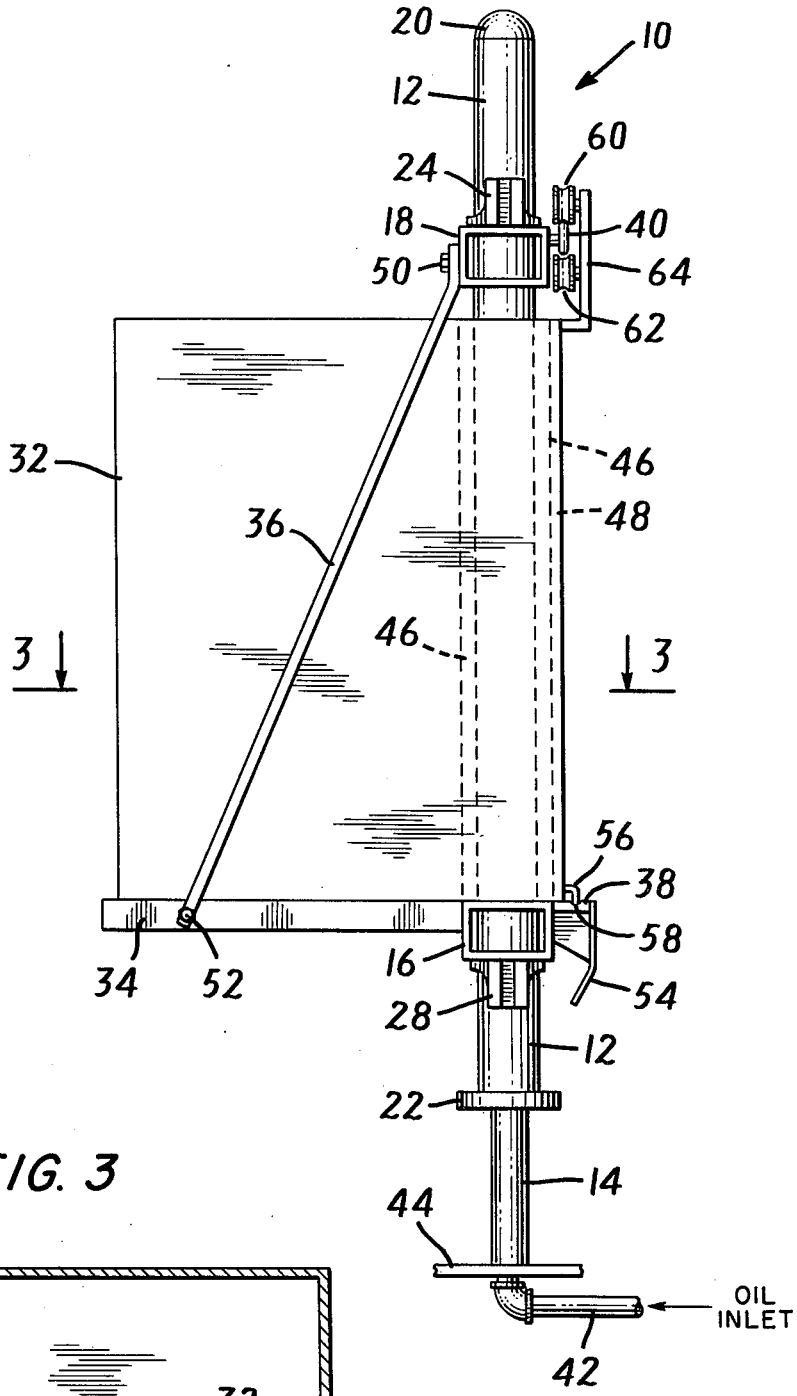
FIG. 2 is a side elevational view of the lifting frame of FIG. 1 with an elevator cab carried thereby.
Figure 3:
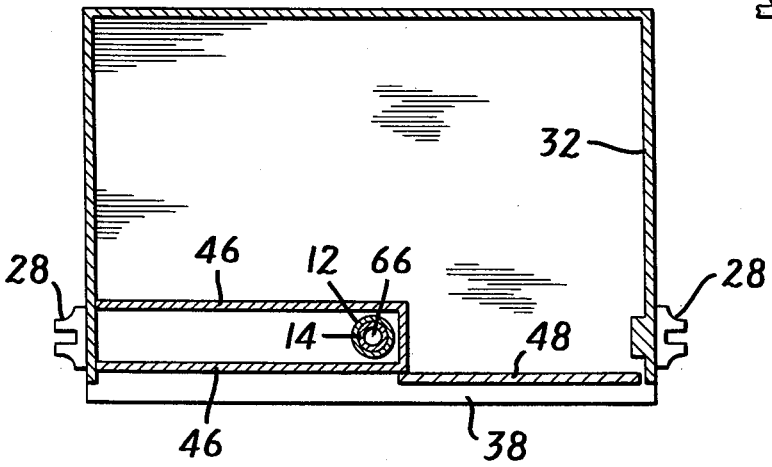
FIG. 3 is a cross-sectional view, taken along the lines 3—3 in FIG. 2 and looking in the direction of the arrows, of the lifting frame and elevator cab of FIG. 2.

In FIGS. 2 and 3, a conventional elevator cab 32 is mounted on the lifting frame 10 intermediate the lower and upper horizontal support members 16 and 18, respectively. The cab 32 is carried by a platform 34 which extends horizontally, into the hoistway (not shown), from the lower horizontal support member 16. A stay rod 36 is used to support the end of the platform 34 furthest from the lower horizontal support member 16. An upper end of the stay rod 36 is attached to the upper horizontal support member 18 by a bolt 50, while a lower end of the stay rod 36 is attached to a side of the platform 34 by a bolt 52. If desirable, a pair of stay rods 36 may be employed, one on each side of the elevator cab 32. Although not shown in FIG. 2, the platform 34 may also be removably bolted to the lower horizontal support member 16. By bolting the various elements in place, assembly of the lifting frame 10 in the restricted confines of the hoistway is facilitated.

The cylinder 12 extends upward through the elevator cab 32 in a door return column 46, which conventionally houses an operating panel and other equipment. A door 48 is slidably disposed in a conventional manner in the front end of the elevator cab 32 adjacent the door return column 46. The upper edge of the door 48 is guided, during the opening and closing thereof, by an upper roller 60 which rides on a door track 40 mounted on the upper horizontal support member 18. The upper roller 60 and a lower roller 62, which rides free of the door track 40 and serves to prevent the accidental derailment of the upper roller 60 from the door track 40, are attached to the upper edge of the door 48 by an L-shaped bracket 64. Similarly, the lower edge of the door 48 is guided by a door gib 56 which rides in a groove 58 in a sill 38. The sill 38 is horizontally suspended from the lower support member 16 in a direction opposite to that of the platform 34. A downwardly extending toe guard 54 is suspended from the bottom of the sill 38.

The piston 14 is fixedly mounted in a vertical position from the bottom surface 44 of the hoistway (not shown). The piston 14 and the cylinder 12, which is slidably mounted about the piston 14 for reciprocating vertical movement thereon, form a fluid pressure responsive jack.

An axial bore 66 provided in the piston 14 has an inlet located at the lowermost end of the piston 14 and an outlet located at the uppermost end of the piston 14. The inlet is connected to a source of hydraulic fluid (not shown) by a pipe or conduit 42, while the outlet communicates with the interior of the cylinder 12. Thus the bore 66 in the piston 14 forms a fluid conduit between the source of hydraulic fluid and the cylinder 12. When hydraulic fluid is introduced into the cylinder 12 the lifting frame 10 and the elevator cab 32 carried thereby may be vertically raised in the hoistway to a height determined by the length of the piston 14 and the cylinder 12. It should be noted that any suitable sealing mechanism (not shown) may be housed in the flange 22 of the cylinder 12 to prevent the hydraulic fluid from leaking therefrom.

In the preferred embodiment of FIGS. 1–3, the piston 14 and the cylinder 12 are approximately the same length. Thus the travel of the lifting frame 10 is limited to one half the length of the hoistway. To overcome this disadvantage the hoistway may be provided with a pit or the overhead clearance may be increased in the area directly above the cylinder. In this regard, any desired arrangement may be provided on the roof of the building to accommodate the cylinder when it is fully extended.

Thus there is provided, in accordance with the invention, a novel and improved hydraulic elevator installation wherein an extensible cylinder of a fluid pressure responsive hydraulic jack is simultaneously utilized as a structural component of a lifting frame for vertically transporting an elevator cab up and down in a hoistway.

It will be understood by those skilled in the elevator art that the above described embodiment is meant to be merely exemplary and that it is susceptible of modification and variation without departing from the spirit and scope of the invention. For example, a plurality of cylinders may be utilized. Therefore, the invention is not deemed to be limited except as defined in the appended claims.

I claim:

1. An hydraulic elevator installation for vertically transporting up and down in a hoistway, an elevator cab having a door, an operating panel and a door return column adjacent the door for housing the operating panel, comprising a piston fixedly mounted in a vertical position in the hoistway; and a lifting frame for carrying the elevator cab, including a cylinder extending upward through the elevator cab in the door return column thereof and slidably mounted about said piston for vertical reciprocating movement thereon, wherein said cylinder forms a rigidly integrated, vertical support member of said lifting frame.

2. An hydraulic elevator installation according to claim 1, wherein said lifting frame further comprises a lower horizontal support member rigidly attached to said cylinder and an upper horizontal support member rigidly attached to said cylinder and located a predetermined distance above said lower horizontal support member.

3. An hydraulic elevator installation according to claim 2, wherein said cylinder and said lower and upper horizontal support members are located in a vertical plane substantially parallel to the door of the elevator cab.

4. An hydraulic elevator installation according to claim 2, further comprising a pair of parallel guide rails extending vertically in the hoistway and lying in a vertical plane defined by said cylinder and said lower and upper horizontal support members; and two pairs of vertically aligned lower and upper rail guide means carried by said lower and upper horizontal support members, respectively, and engageable with said guide rails for centering said lifting frame between said guide rails during the vertical movement of said lifting frame in the hoistway.

5. An hydraulic elevator installation according to claim 2, further comprising a platform extending horizontally outward into the hoistway from said lower horizontal support member; a stay rod connected between said upper horizontal support member and said platform; a door track attached to said upper horizontal support member for guiding the movement of the door of the elevator cab during the opening and closing of the door; and a sill horizontally suspended from said lower support member in a direction opposite to that of said platform.

6. An hydraulic elevator installation according to claim 1, wherein the elevator cab has a front end defined by the door, said lifting frame being positioned adjacent the front end of the elevator cab.

7. An hydraulic elevator installation according to claim 1, wherein said cylinder is the sole vertical support member of said lifting frame.

8. An hydraulic elevator installation for vertically transporting up and down in a hoistway, an elevator cab having a door and door return column adjacent thereto for housing an operating panel of the elevator cab, comprising a source of hydraulic fluid; a fluid pressure responsive hydraulic jack including a piston fixedly mounted in a vertical position in the hoistway, said piston having an axial bore therethrough, and a cylinder extending upward through the elevator cab in the door return column thereof and slidably mounted about said piston for reciprocating vertical movement thereon, wherein said bore has an inlet located at the lowermost end of said piston and connected to said source of hydraulic fluid for receiving hydraulic fluid from said source of hydraulic fluid and an outlet located at the uppermost end of said piston and communicating with said cylinder for supplying hydraulic fluid to said cylinder, whereby said cylinder reciprocates vertically on said piston under the influence of fluid pressure conditions within said cylinder; a lifting frame for carrying the elevator cab, said lifting frame including said cylinder, a lower horizontal support member rigidly attached to said cylinder and an upper horizontal support member rigidly attached to said cylinder and located a predetermined distance above said lower horizontal support member, said lower and upper support members located in a vertical plane substantially parallel to the door of the elevator cab; a pair of parallel guide rails extending upwardly in the hoistway and lying in a vertical plane defined by said cylinder and said lower and upper horizontal support members; and two pairs of vertically aligned lower and upper rail guide means carried by said lower and upper horizontal support members, respectively, and engageable with said guide rails for centering said lifting frame between said guide rails during the vertical movement of said lifting frame in the hoistway.

* * * * *